United States Patent [19]

Flamme et al.

[11] 4,285,453

[45] Aug. 25, 1981

[54] WIRE INSERTION APPARATUS, PARTICULARLY FOR FORMING PRESSES

[75] Inventors: Walter Flamme, Wegberg-Beeckerheide; Willi Mielke, Duisburg-Mündelheim, both of Fed. Rep. of Germany

[73] Assignee: Peltzer & Ehlers GmbH & Co., Krefeld, Fed. Rep. of Germany

[21] Appl. No.: 100,273

[22] Filed: Dec. 4, 1979

[51] Int. Cl.[3] ..... B65H 17/26; B65H 17/22

[52] U.S. Cl. ..... 226/142; 226/152

[58] Field of Search ..... 226/135, 138, 139, 140, 226/141, 142, 152

[56] References Cited

U.S. PATENT DOCUMENTS

| | | | |
|---|---|---|---|
| 2,495,885 | 1/1950 | Blume | 226/141 |
| 2,514,261 | 7/1960 | Scheffey | 226/142 |
| 3,076,368 | 2/1963 | Groll | 226/141 |
| 3,664,220 | 5/1972 | Blair | 226/137 |

*Primary Examiner*—Edward J. McCarthy

*Attorney, Agent, or Firm*—Shlesinger, Arkwright, Garvey & Dinsmore

[57] ABSTRACT

A wire insertion apparatus particularly for forming presses and the like comprising at least one pair of insertion rollers between which a wire or rod is periodically advanced by a predetermined insertion length, a crank and connecting rod mechanism connecting at least one of the insertion rollers to a drive shaft for producing a periodic angular movement of the insertion rollers, the mechanism comprising an intermediate lever member pivotally mounted on an axis, first and second linkage rods connecting the intermediate member respectively with an eccentric on the drive shaft and an eccentric mounted on one of the insertion rollers so that rotation of the drive shaft produces angular movement of the insertion roller in response to pivotal motion of the intermediate lever member, and means for shifting the pivot point of one of the linkage rods so as to change the distance between the pivot axis and that rod and thereby change the degree of angular movement of the insertion rollers.

7 Claims, 2 Drawing Figures

WIRE INSERTION APPARATUS, PARTICULARLY FOR FORMING PRESSES

Figure 1:
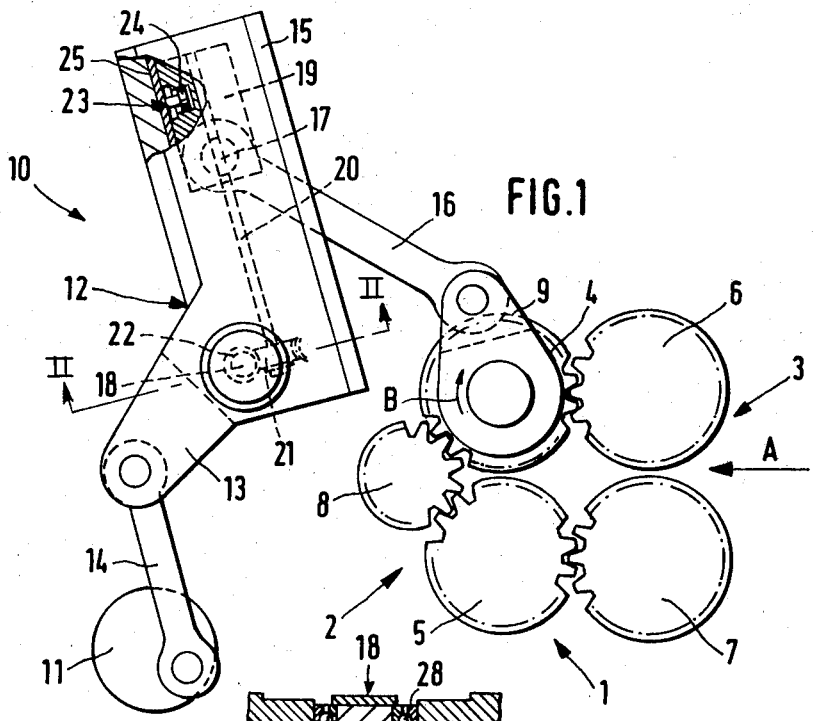

The invention concerns a wire insertion apparatus, particularly for forming presses, said apparatus having at least one pair of opposed insertion rollers, between the shaped grooves of which rollers a wire or rod is periodically advanced into the forming press, to the extent of a set insertion length, and at least one of which rollers is connected via a crank and connecting-rod mechanism to a drive shaft, for producing a corresponding periodic angular movement, with said mechanism comprising at least one drive rod pivotably linked directly to cranks on the drive shaft and the insertion roller or at least on one side to an intermediate lever, whereby at least one of the two linkage points of said drive rod is provided with an adjusting mechanism for modifying the distance to either the swing axle or the rotational axle (as the case may be).

Known insertion apparatuses have typically one or two insertion roller pairs between the shaped grooves of which a wire or rod can be advanced into the forming press. Then in the forming press itself the forward part of the wire or rod corresponding to the current value of the insertion length is cut off and formed into a pressed piece.

The insertion of the wire or rod occurs at periodic intervals. For this the insertion rollers are synchronously rotated through an angle corresponding to the insertion stroke. Under this arrangement the insertion rollers are interconnected by gears so that it is sufficient for only one of the insertion rollers to be driven. The driving is accomplished through a drive shaft and a subsequent crank and connecting rod mechanism which converts the rotational motion of the drive shaft to back-and-forth motion.

For this purpose a crank is mounted on the drive shaft (or formed in it), to which crank a drive rod is pivotably linked at one end (of said drive rod), while the other end is attached to a second crank at the insertion roller. The transmission ratios in this system are choosen such that the crank of the insertion roller is swung back and forth over a set angular excursion. To provide that the insertion roller performs only a corresponding motion in the insertion direction, a freewheel is located between said roller and the crank. This freewheel interrupts force transmission when the crank is moving oppositely to the insertion direction. Often an intermediate lever is disposed between the two cranks; this lever is connected to each of the cranks by a respective drive rod.

The insertion length, i.e. the amount of the wire or rod which is inserted into the forming press in one insertion motion, is typically adjustable. The adjustment is performed by changing the eccentricity of one of the two cranks, or, if an intermediate lever is present, by changing the distance between the swing axis of the intermediate lever and the pivot point of the drive rod. In this way the swing sxcursion of the crank at the insertion roller is changed, and thereby the rotational angle of the insertion roller.

For this purpose the pivot point of the drive rod is attached to a sliding block which is translatable (i.e. slidable) by a screw, said translation being radially over the crank or over the intermediate lever. The screw is rotated by hand after loosening a locking mechanism. In order to perform this operation the entire machine must be stopped, which is very inconvenient and time-consuming.

Accordingly, the problem underlying the invention is to design the adjusting mechanism of an insertion apparatus of the type described, so that the insertion length may be quickly adjusted without stopping the machine.

This problem is solved according to the invention in that the adjusting mechanism has a shifting motor which is disposed on the crank or on the intermediate lever. The distance of the pivot point from the swing axle or the rotational axle (as the case may be) can be changed by controlled operation of this shifting motor. In this it is of particular advantage that the shifting motor is disposed on the crank or on the intermediate lever, since now the insertion apparatus and the entire machine do not need to be stopped for the adjusting procedure.

In embodying the invention it is provided that the shifting motor is in the form of a stepping motor, wherewith it is advantageous to provide the shifting motor with a step indicator for digital telemetry of the instantaneous current position of the pivot point. In this way the adjustment can be generated from a control panel without visual observation.

According to another feature of the invention it is proposed that the shifting motor be disposed on the axis (rotational axis or swing axis) of the crank or of the intermediate lever, espectively. This keeps the inertial and certrifual forces small; electrical connections are not a problem, due to the small rotational excursions. The device can be devised such that the shifting motor is connected through a worm gear drive to a radially extending adjusting screw for radial sliding of a sliding block, which bears the pivot point.

The invention further provides that the adjusting mechanism has a locking mechanism, to lock it after the adjusting process. According to the invention this locking mechanism may comprise a hydraulic clamping piston disposed in the sliding block, which piston fixedly clamps the block in its guideway.

Finally, it is proposed according to the invention that the adjusting mechanism is disposed on an intermediate lever which is connected on one side via the drive rod to the crank of the insertion roller, and on the other side via a connecting rod to the crank of the drive shaft.

The invention is illustrated in more detail in the drawings, with the aid of an example embodiment.

Figure 2:
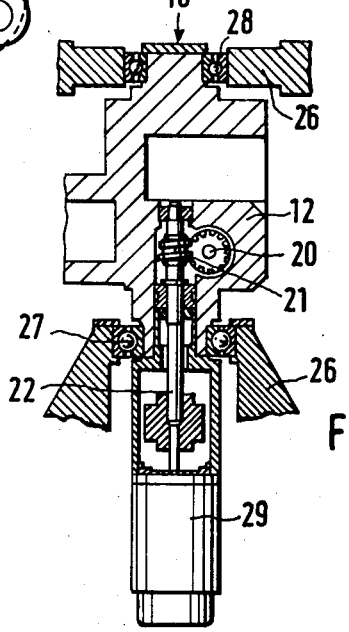

FIG. 1 shows a schematic side view of the most important part of an insertion along lines II-II apparatus for a forming press; and FIG. 2 is a cross section through the intermediate lever of the insertion apparatus of FIG. 1.

FIG. 1 shows a schematic side view of the most important part of an insertion apparatus 1. This comprises two insertion roller pairs 2 and 3, each pair having two insertion rollers (4 and 5, and 6 and 7) disposed one above the other. During operation, a wire or rod is inserted between these insertion roller pairs 2 and 3, in the direction of arrow A.

Insertion rollers 4 and 5 which are disposed one behind the other, and likewise insertion rollers 6 and 7, are connected by a gear assembly (not shown), and the two front insertion rollers 4 and 5 are connected by gear 8. As a consequence of these gear linkages, it is sufficient for only one insertion roller to be driven, namely, in the case shown, roller 4.

A crank 9 is mounted on the axle of this insertion roller 4, and a freewheel is located between crank 9 and roller 4. This freewheel locks only in the insertion direction (arrow B), while in the opposite direction there is no force transmission. When crank 9 moves back and forth, insertion rollers 4 through 7 are thus rotated only in one direction, namely the insertion direction.

The back and forth motion of crank 9 is produced by a connecting rod assembly 10 which is connected to drive shaft 11. Connecting rod assembly 10 has an intermediate lever (swivel lever) 12 in the form of a double lever, one lever arm 13 of which is pivotably linked to a connecting rod 14 which is eccentrically pivoted on drive shaft 11, crank-style. Rotational motion of drive shaft 11 thus produces back-and-forth motion of intermediate lever 12.

A driving rod 16 is pivotably linked to the other lever arm 15 of intermediate lever 12; the other end of this rod 16 is connected to crank 9 of insertion roller 4. In this manner the back-and-forth motion of intermediate lever 12 is transmitted to crank 9.

For modifying the angular excursion of the back-and-forth movement of crank 9 and thus the insertion length, lever arm 15 of intermediate lever 12 has an adjusting mechanism by which the distance of pivot point 17 from swing axle 18 may be modified. In particular, pivot point 17 is located on a sliding block 19 which is slidably guided in the longitudinal direction of lever arm 15, which is a roughly radial direction. The sliding is accomplished with the aid of screw 20 which passes through the sliding block 19 and the lower end of which is connected to the rotating shaft 22 of a stepping motor, which shaft runs coaxially with swing axle 18; said connection is accomplished by means of worm gear drive 21. Screw 21 can then be rotated by subjecting the stepping motor to control action, thus causing the sliding block 19 to slide. The farther radially outward the block moves the greater the angle of excursion of crank 9 and thus the greater the insertion length.

After the adjustment of the insertion length the sliding block can be fixed by fixing mechanism 23, which comprises a smaller hydraulic piston 24 which when subjected to hydraulic pressure is pressed against the guiding wall 25 of sliding block 19 and thereby locks said block.

FIG. 2 shows a cross section through intermediate lever 12, at the level of the swing axle 18 and perpendicular to the longitudinal axis of screw 20.

Intermediate lever 12 is pivotably mounted in the housing 26 of insertion apparatus 1, on two pivots 27 and 28. Stepping motor 29 is attached to intermediate lever 12 in such a way that its rotating shaft 22 is coaxial with swing axle 18. Thereby it moves along with intermediate lever 12, so that during operation (when the lever 12 is moving) the rotational motion of stepping motor 29 is transmitted through worm gear drive 21 to screw 20. In this way the insertion length can be adjusted by simply actuating stepping motor 29, without stopping the operation of the insertion apparatus.

We claim:

1. A wire insertion apparatus for forming presses and comprising at least one pair of insertion rollers between which a wire or rod is periodically advanced by a predetermined insertion length, a crank and connecting rod mechanism connecting at least one of said insertion rollers to drive shaft for producing a periodic angular movement of said at least one of said insertion rollers, said mechanism comprising an intermediate lever member pivotally mounted about an axis, a first linkage rod connecting said intermediate lever member with a first eccentric on said drive shaft for pivoting said intermediate lever member, a second linkage rod connecting said intermediate lever member with a second eccentric mounted on said at least one insertion roller for producing said angular movement in response to pivotal motion of said intermediate lever member, shifting motor means mounted on said axis for changing the distance between said axis and the pivot point connection between said intermediate lever member and said second linkage rod and thereby changing the degree of said angular movement of said at least one insertion roller.

2. Wire inserting apparatus according to claim 1, characterized in that said shifting motor comprises a stepping motor (29).

3. Wire insertion apparatus according to claim 2, characterized in that said stepping motor (29) is provided with a step indicator for telemetry of the current position of the pivot point (17).

4. Wire insertion apparatus according to claim 2 characterized in that said stepping motor (29) is connected through a worm gear drive (21) to a radially extending adjusting screw (20) for radial sliding of a sliding block (19) mounted on said intermediate lever member and bearing said pivot point (17).

5. Wire insertion apparatus according to claim 4 characterized in that said shifting motor means includes a locking mechanism (23).

6. Wire insertion apparatus according to claim 5 characterized in that said locking mechanism (23) comprises a hydraulic clamping piston (24) disposed in said sliding block (19).

7. A wire insertion apparatus as in claim 6 and wherein said shifting motor means is mounted on said intermediate lever member.

* * * * *